US010771885B2

(12) United States Patent
Kamimura

(10) Patent No.: US 10,771,885 B2
(45) **Date of Patent: *Sep. 8, 2020**

(54) HEADPHONE DEVICE

(71) Applicant: JVCKENWOOD Corporation, Yokohama-shi, Kanagawa (JP)

(72) Inventor: Shinji Kamimura, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/504,736

(22) Filed: Jul. 8, 2019

(65) Prior Publication Data

US 2020/0029145 A1 Jan. 23, 2020

(30) Foreign Application Priority Data

Jul. 18, 2018 (JP) ..... 2018-134737

(51) Int. Cl.
*H04R 1/10* (2006.01)
*H04R 5/033* (2006.01)

(52) U.S. Cl.
CPC ..... *H04R 1/105* (2013.01); *H04R 1/1008* (2013.01); *H04R 1/1066* (2013.01); *H04R 5/0335* (2013.01); *H04R 2201/107* (2013.01)

(58) Field of Classification Search
CPC .... H04R 1/1008; H04R 1/105; H04R 1/1058; H04R 1/1066; H04R 5/033; H04R 5/0335; H04R 2201/107; H04M 1/05
USPC ..... 381/309, 370, 374, 376, 377, 378, 379, 381/383; 181/128, 129; 2/209
See application file for complete search history.

(56) References Cited

U.S. PATENT DOCUMENTS 4,409,442 A * 10/1983 Kamimura ..... H04R 5/0335 381/370
8,737,668 B1 * 5/2014 Blair ..... H04R 1/1066 381/378
2014/0023222 A1 * 1/2014 Ito ..... H04R 5/0335 381/379

FOREIGN PATENT DOCUMENTS

JP 2017-98869 A 6/2017

* cited by examiner

*Primary Examiner* — Huyen D Le
(74) *Attorney, Agent, or Firm* — Nath, Goldberg & Meyer; Jerald L. Meyer

(57) ABSTRACT

A headphone device includes a head pad, a band, and a sleeve. The head pad has a curved shape with a first radius of curvature. The band extends from an edge of the head pad into a curved shape with a second radius of curvature different from the first radius of curvature, and supports a housing, via a hanger, housing a speaker unit. The sleeve has a curved shape with the first radius of curvature and is slidable along the head pad to cover the band so as to change the radius of curvature at a part of the band covered with the sleeve to approximate to the first radius of curvature.

4 Claims, 10 Drawing Sheets

HEADPHONE DEVICE

CROSS REFERENCE TO RELATED APPLICATION

This application is based upon and claims the benefit of priority under 35 U.S.C. § 119 from Japanese Patent Application No. 2018-134737 filed on Jul. 18, 2018, the entire contents of which are incorporated herein by reference.

BACKGROUND

The present disclosure relates to a headphone device enabling a lateral pressure adjustment.

Japanese Patent Application Publication No. 2017-098869 (Patent Literature 1) discloses a headphone device enabling a lateral pressure to be adjusted when worn on the head.

The headphone device disclosed in Patent Literature 1 includes a plate spring to be put across the head of a user and corresponding to a typical head band having both ends to be located around the right and left ears, and further includes a lateral-pressure adjustable spring, an adjuster, and spacers arranged between the lateral-pressure adjustable spring and the adjuster, so as to adjust a lateral pressure together with the plate spring.

SUMMARY

The headphone device disclosed in Patent Literature 1 inevitably increases the number of components, which should be reduced, necessary for adjusting a lateral pressure.

The headphone device disclosed in Patent Literature 1 has the further disadvantage of hindering the user from visually recognizing a level of a lateral pressure to be adjusted. The headphone device impedes an easy and quick adjustment to a lateral pressure fit for each individual user when several users use the common headphone device, for example. Thus, a need exists for facilitating the adjustment to a lateral pressure to be fit for each user.

An aspect of one or more embodiments provides a headphone device including: a head pad having a curved shape with a first radius of curvature; a band extending from an edge of the head pad into a curved shape with a second radius of curvature different from the first radius of curvature, and supporting a housing, via a hanger, housing a speaker unit; and a sleeve having a curved shape with the first radius of curvature and slidable along the head pad to cover the band so as to change the radius of curvature at a part of the band covered with the sleeve to approximate to the first radius of curvature.

DETAILED DESCRIPTION

A headphone device 51 according to one or more embodiments is described below with reference to FIG. 1 to FIG. 4.

Figure 1:
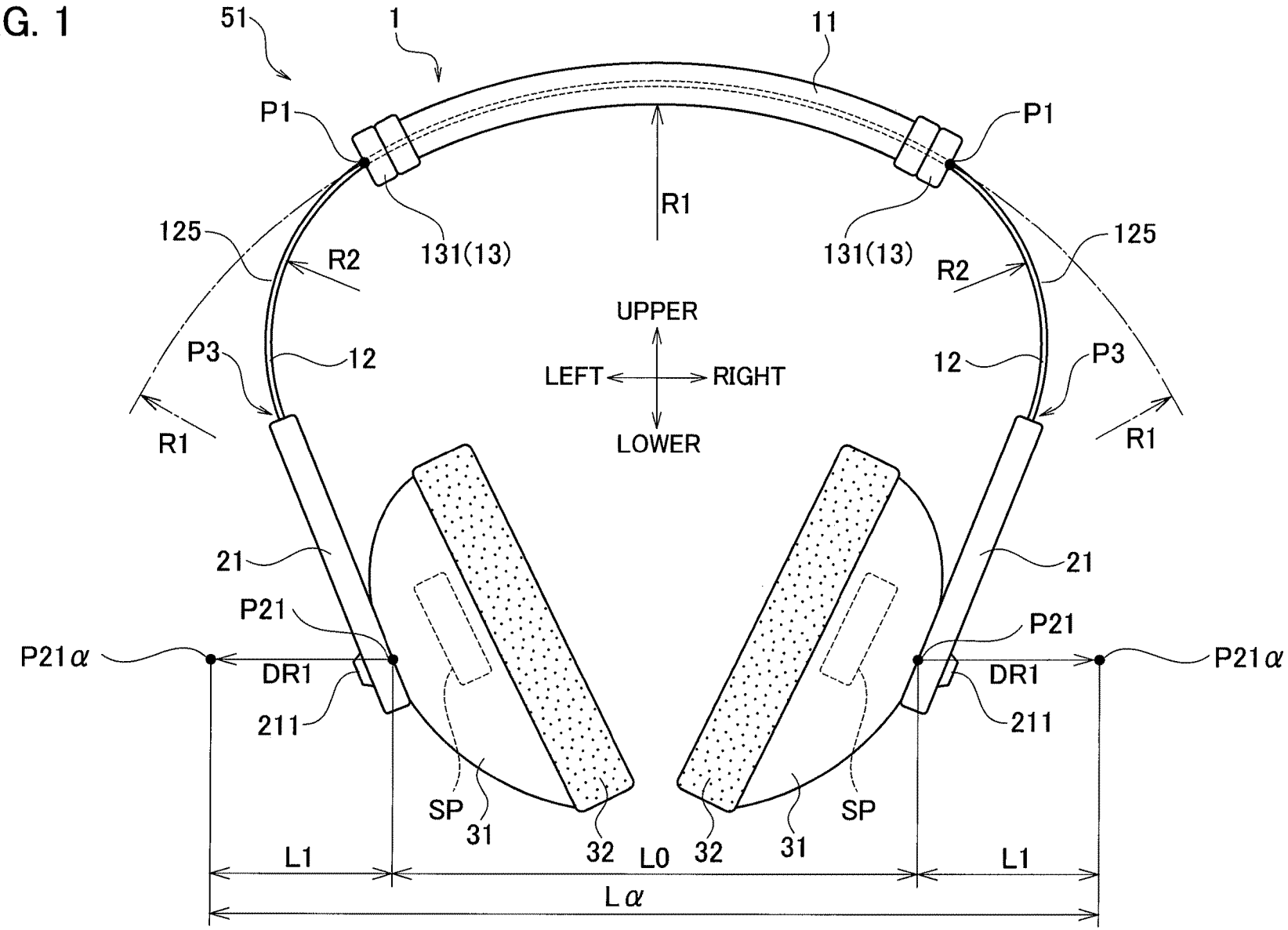
FIG. 1 is a rear view showing a headphone device in a first state according to one or more embodiments.

As shown in FIG. 1, the headphone device 51 includes a head band 1, a hanger 21 and a housing 31 for the left ear attached to the left end of the head band 1, and a hanger 21 and a housing 31 for the right ear attached to the right end of the head band 1.

The head band 1 includes a head pad 11 housing extendable and retractable sleeves 13. The sleeves 13 are slidably moved by fingers of a user along a band 12 extending from the head pad 11 so as to be freely drawn out of the head pad 11.

Figure 2:
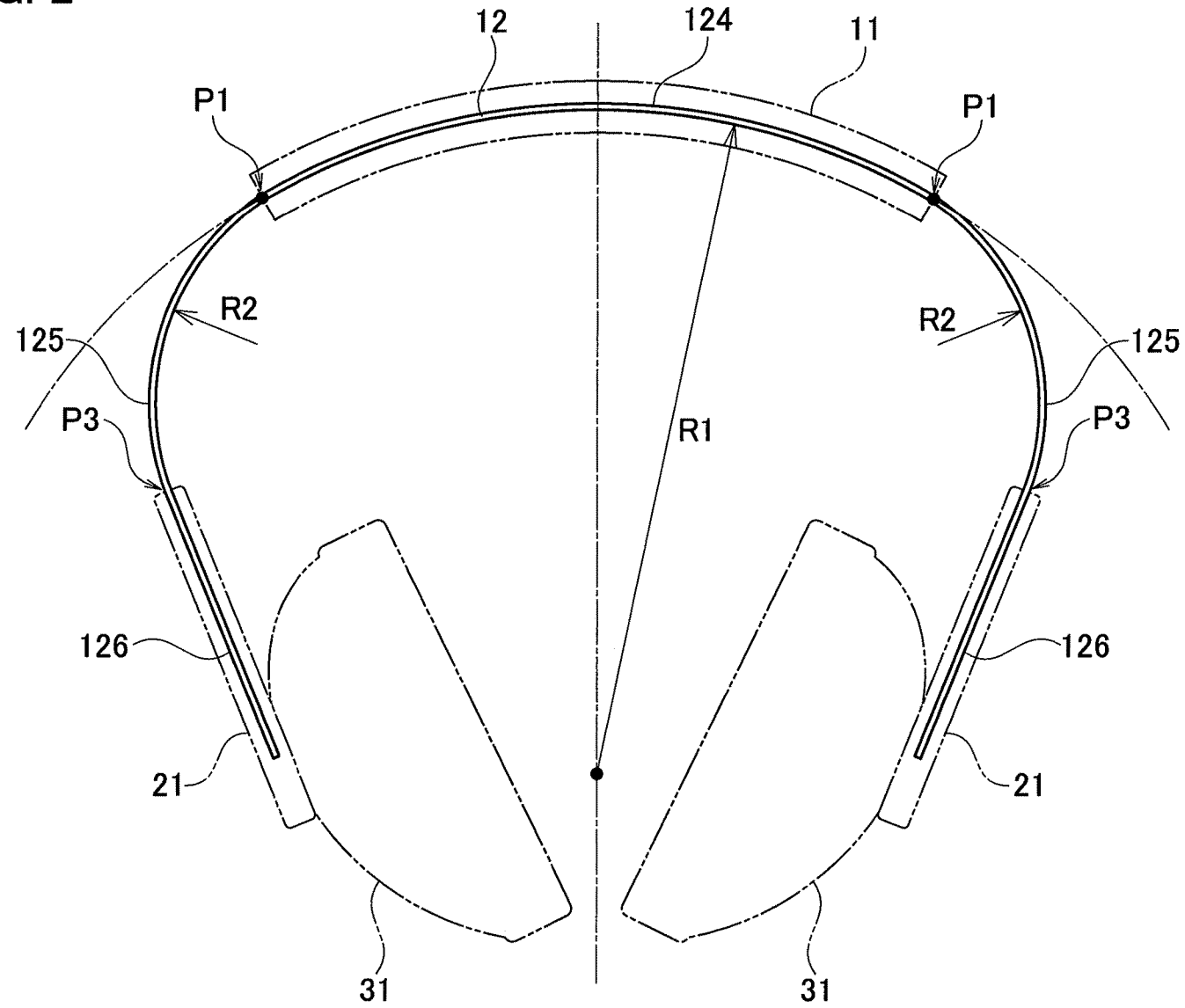
FIG. 2 is a front view showing a band included in the headphone device according to one or more embodiments.

FIG. 1 illustrates the headphone device 51 in a first state in which the sleeves 13 are slid to be housed in the head pad 11 to the maximum. The upper, lower, left, and right directions are indicated by the arrows shown in FIG. 1. The front side on the paper of each of FIG. 1 and FIG. 2 is defined as a rear side.

The headphone device 51 yields a lateral pressure that varies depending on the drawn amount of the sleeves 13. The lateral pressure is a pressure applied around the temples of the user of the headphone device 51 via ear pads 32. The user of the headphone device 51 can adjust a level of the lateral pressure by regulating the drawn amount of the sleeves 13.

Each of the hangers 21 includes a pivot support 211 at its bottom to pivotally support the housing 31. The housing 31 houses a speaker unit SP to emit sounds toward the opposite housing 31 in the state shown in FIG. 1. The ear pad 32, in contact with each ear when the headphone device 51 is worn on the head, is attached on the sound-emitting side of the housing 31.

Figure 3:
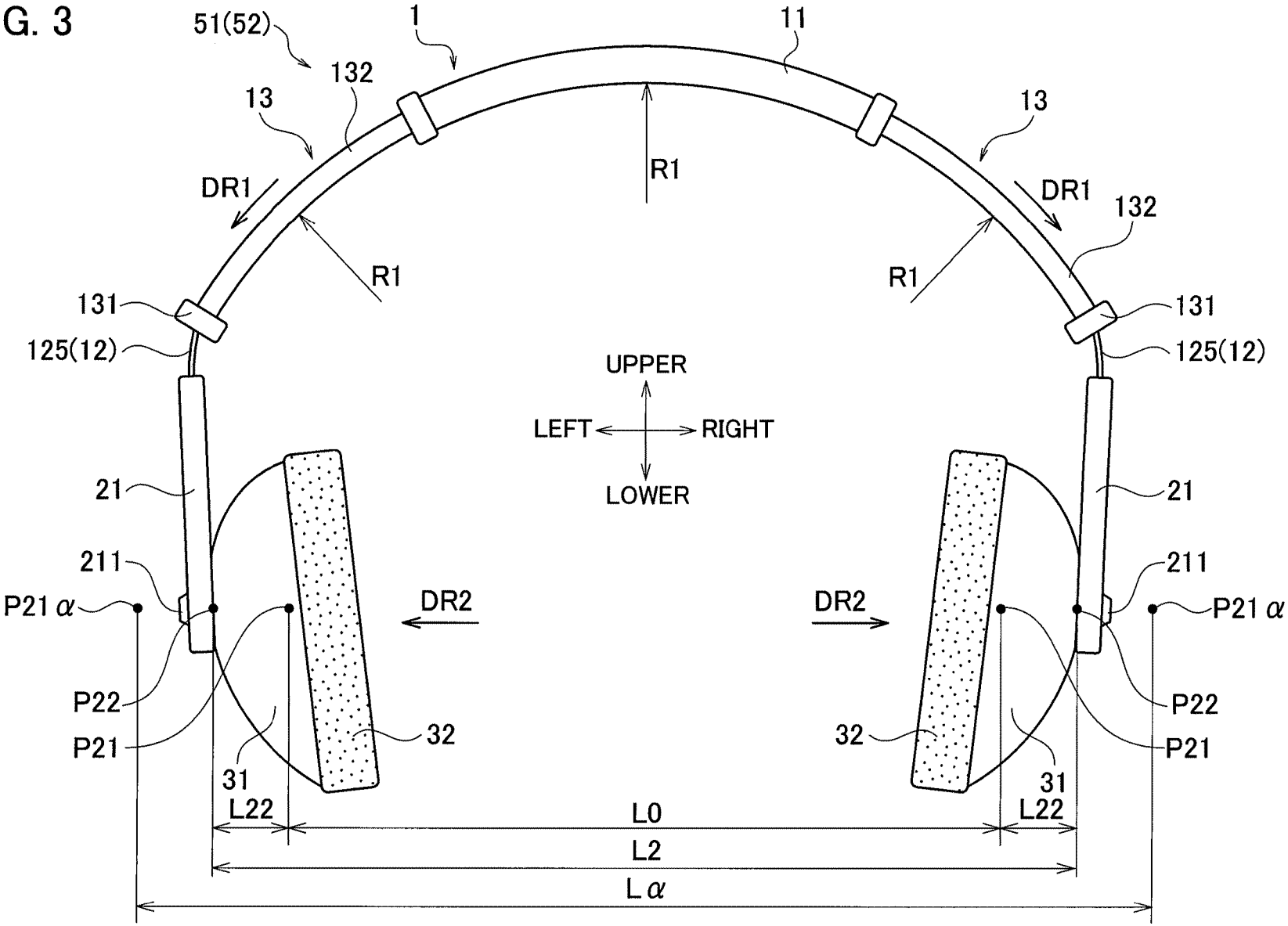
FIG. 3 is a rear view showing the headphone device in a second state according to one or more embodiments.
Figure 4:
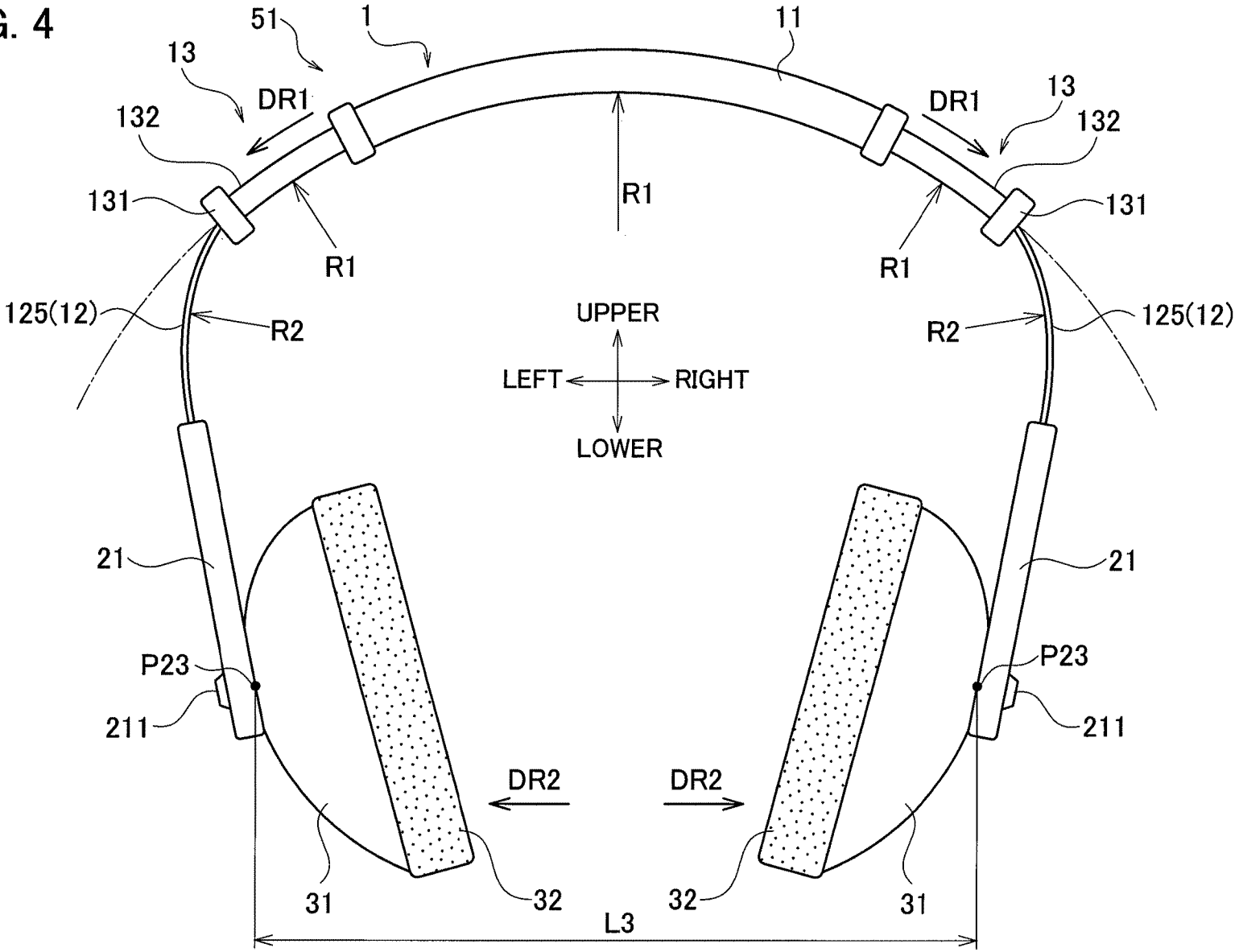
FIG. 4 is a rear view showing the headphone device in a third state according to one or more embodiments.

The hangers 21 having a known structure used in a conventional headphone device are each vertically adjustable with respect to the band 12. FIG. 1, FIG. 3, and FIG. 4 each show a state in which the hangers 21 are located at the uppermost position with respect to the band 12.

The head band 1 includes the head pad 11, the band 12, and the sleeves 13. The head pad 11 is placed on the top of the head, for example, when the headphone device 51 is worn on the head. The head pad 11 is an arc-like sheath-shaped housing having an approximate radius R1 in the front view. The head pad 11 includes a plurality of resin-based members combined together, for example.

FIG. 2 is a front view of the band 12. The band 12 is a flat curved member made of metal or resin. The band 12 has flexibility in the increasing/decreasing direction of the radius of curvature.

The band 12 includes an arc-like middle portion 124 having a radius R1 in the front view, a pair of arc-like extending portions 125 connected to both ends of the middle portion 124 and having a radius R2 in the front view, and a pair of plate-like end portions 126 extending from the tips of the extending portions 125. The radius R1 is presumed to be a value approximate to an average radius of curvature of the head of an ordinary person.

The middle portion 124 have the same radius R1 as the head pad 11, and is inserted and fixed to the inside of the head pad 11. The extending portions 125 extend out of the head pad 11 on both sides in the longitudinal direction to have an arc shape with the radius R2 different from the radius R1. The end portions 126 having a plate-like shape are connected to be housed in the hangers 21. The band 12 has a smaller flexural rigidity than the sleeves 13. The following is a case in which the radius R2 is smaller than the radius R1.

Figure 5:
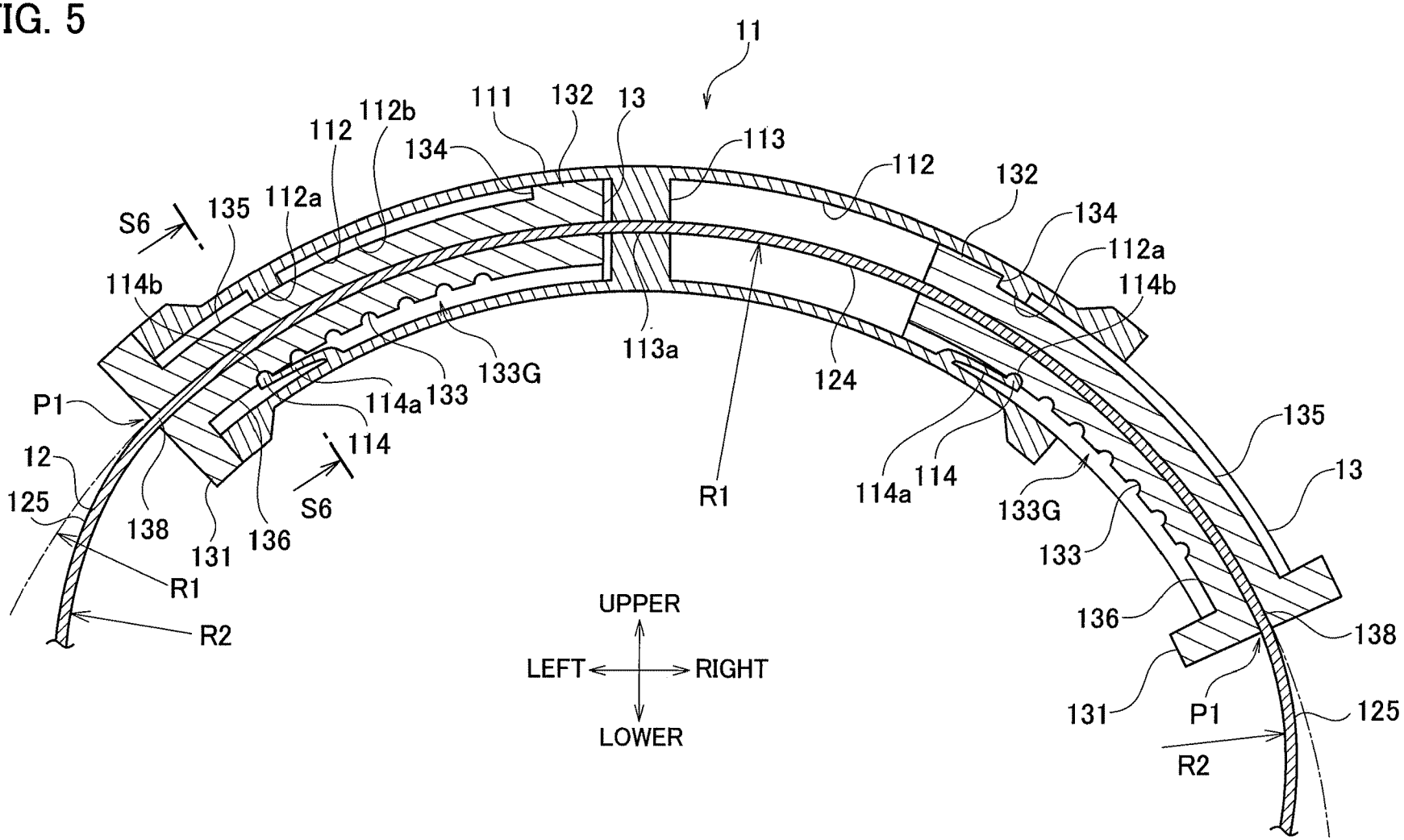
FIG. 5 is a vertical cross-sectional view showing a head pad included in the headphone device according to one or more embodiments.
Figure 6:
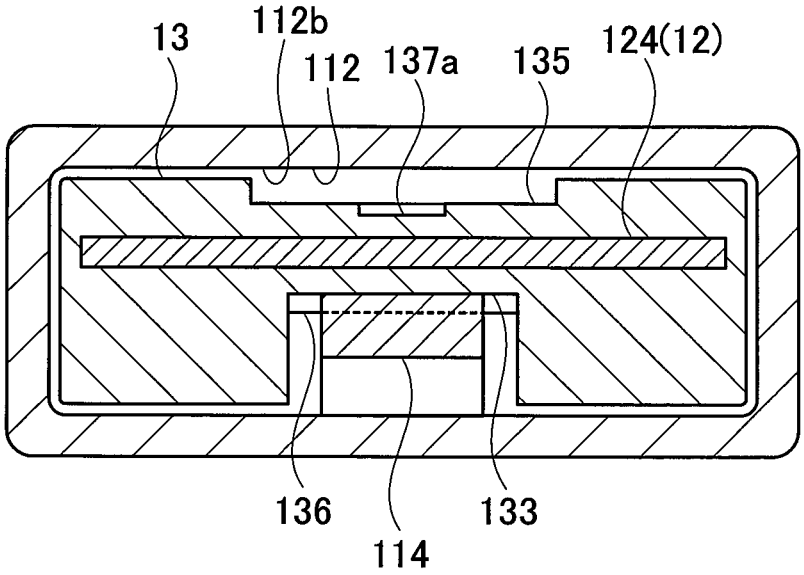
FIG. 6 is a cross-sectional view taken along line S6-S6 in FIG. 5.

Next, the structure of the head pad 11 and the movement of the sleeves 13 are illustrated in detail below mainly with reference to FIG. 5 and FIG. 6. FIG. 5 is a vertical cross-sectional view of the head pad 11 along the middle portion in the front-rear direction, and FIG. 6 is a cross-sectional view taken along line S6-S6 in FIG. 5.

The sleeves 13 are each an arc-like sheath-shaped housing having a radius R1 which is an average radius in the front view, as in the case of the head pad 11 and the middle portion 124 of the band 12, and is made of resin or metal. As described above, the sleeves 13 have a greater flexural rigidity than the band 12.

At least part of the sleeves 13 is extendably and retractably housed in the sheath-shaped head pad 11. The sleeves 13 are slidably moved along the band 12 in the longitudinal direction against an elastic repulsive force applied from the band 12 while correcting the curvature of the band 12 to conform to the curvature of the sleeves 13. The flexural rigidity of each of the band 12 and the sleeves 13 and the elastic repulsive force of the band 12 are regulated so that the sleeves 13 can be slid by the fingers of the user while correcting the curvature of the band 12.

The head band 1 having such a configuration can be set in the following first to third states depending on the position of the sleeves 13: The first state is a state in which the sleeves 13 are housed in the head pad 11 to the maximum (FIG. 1). The second state is a state in which the sleeves 13 are drawn out of the head pad 11 to the maximum along the band 12 (FIG. 3). The third state is a state between the first state and the second state in which the sleeves 13 are drawn out not to the maximum but by a freely-selected amount from the first state (FIG. 4).

As shown in FIG. 5, the head pad 11 includes a concentric arc-shaped pad base portion 111 having a radius R1 at a radial position at which the middle portion 124 of the band 12 penetrates in the front view. The pad base portion 111 is a sheath-shaped housing having a symmetric rectangular shape in lateral cross section.

The pad base portion 111 includes a fixed wall portion 113 in the middle in the right-left direction to serve as a partition wall, and a pair of housing portions 112 open at the left and right ends to define the right and left internal spaces partitioned by the fixed wall portion 113. The paired housing portions 112 have a symmetric shape. The housing portion 112 on the left side is mainly described below.

As shown in FIG. 6, the housing portion 112 has a rectangular shape in lateral cross section. As shown in FIG. 5, an upper inner wall 112*b* of the housing portion 112 is provided with a stopper 112*a* projecting downward and located closer to the left end. A lower inner wall 112*c* of the housing portion 112 has an engagement arm portion 114 projecting upward at a position corresponding to the stopper 112*a*.

The engagement arm portion 114 includes an arm piece 114*a* flexible in the vertical direction, and a semicolumnar engagement projection 114*b* elongated in the front-rear direction and protruding upward at the tip of the arm piece 114*a*.

The fixed wall portion 113 has a penetration hole 113*a* through which the right and left housing portions 112 communicate with each other. The band 12 is inserted into the penetration hole 113*a* and fixed to the penetration hole 113*a* in the middle with an adhesive, for example, so as to be integrated with the head pad 11.

The sleeves 13 are described in more detail below. The two sleeves 13 included in the head band 1 are symmetrically housed in the right and left housing portions 112. The sleeve 13 housed in the housing portion 112 on the left side is mainly described below.

The sleeve 13 is a sheath-shaped member having an arc shape in the front view and having a rectangular shape in lateral cross section. The sleeve 13 has an arc-shaped penetration hole 138 open at both ends and having a radius R1. The band 12 is slidably inserted into the penetration hole 138.

The sleeve 13 includes a base 132 and a sleeve head 131. The base 132 can be entirely housed in the housing portion 112. The sleeve head 131 projects outward on the circumference at the end on the opposite side of the base 132 (on the left side), and is in contact with an end surface 115 of the pad base portion 111.

The sleeve 13 has an outer groove 135. The outer groove 135 on the outer diameter side of the head band 1 is hollowed out toward the inner diameter of the head band 1 in the middle in the front-rear direction. The outer groove 135 extends from the bottom of the sleeve head 131 to a part adjacent to the right end of the base 132, and has a contact portion 134 at the right end serving as a wall.

The contact portion 134 comes into contact with the stopper 112*a* at the predetermined maximum extending position so that a further slide is regulated when the sleeve 13 is slid to be drawn out of the head pad 11.

Figure 8:
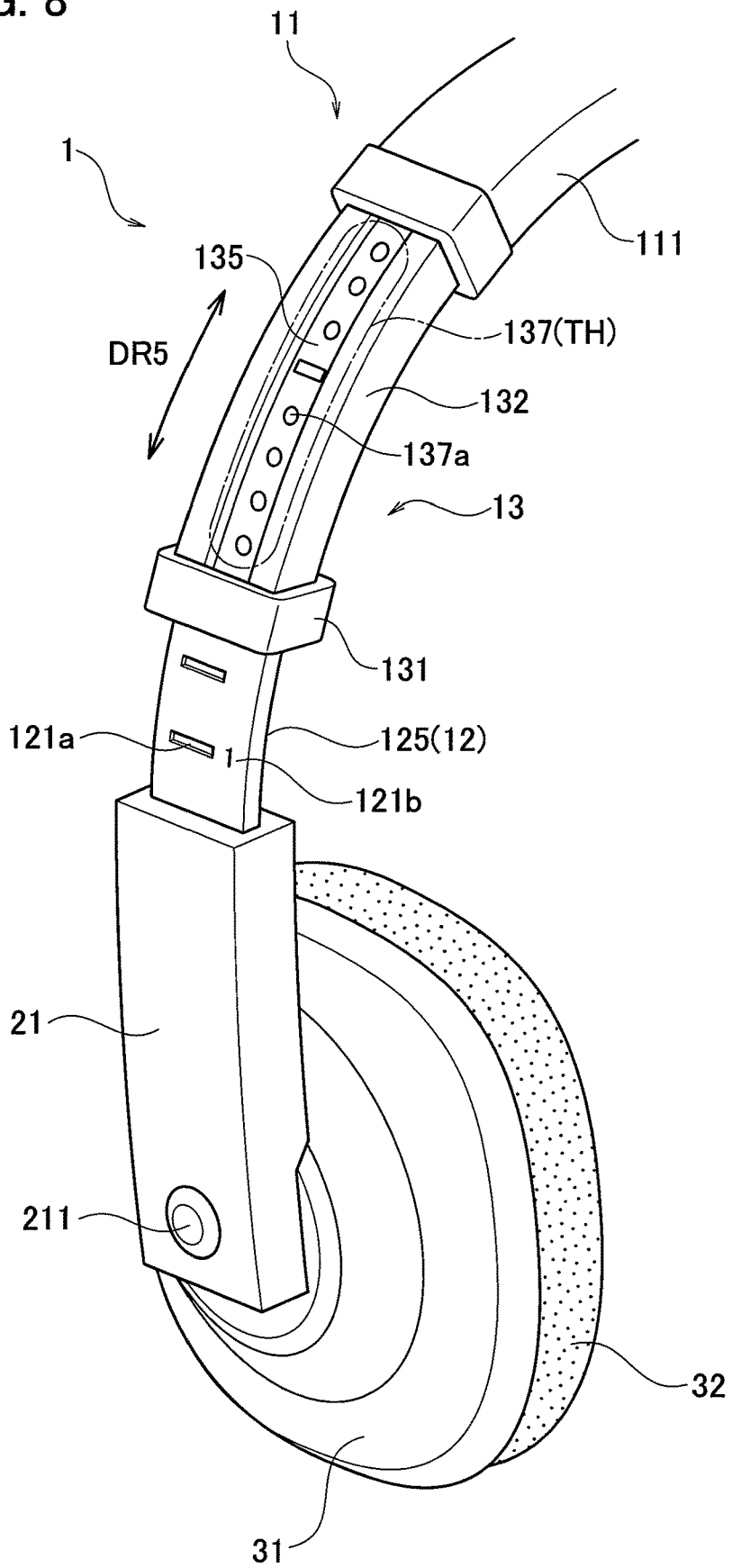
FIG. 8 is a partial perspective view showing the band of the headphone device in the second state according to one or more embodiments.

As shown in FIG. 6 or FIG. 8, the bottom of the outer groove 135 is provided with a plurality of marks 137*a* slightly recessed at regular intervals so as to collectively serve as a sleeve length indicating portion 137. As shown in FIG. 8, the sleeve length indicating portion 137 is a group of the marks 137*a* formed into recesses aligned at regular intervals in the longitudinal direction of the sleeve 13, and serves as an adjusted-amount recognition part TH so as to allow the user to visually recognize the adjusted amount of the hanger 21.

The sleeve 13 has an inner groove 136. The inner groove 136 on the inner diameter side of the head band 1 is hollowed out toward the outer diameter of the head band 1 in the middle in the front-rear direction. The inner groove 136 continuously extends to the end of the base 132, namely, extends from the bottom of the sleeve head 131 to the right end of the base 132.

The bottom of the inner groove 136 is provided with a plurality of engagement recesses 133 hollowed into a semicircle in cross section at regular intervals in the right-left direction and elongated in the front-rear direction. The engagement recesses 133 are collectively referred to as an engagement recess group 133G. Each of the engagement recesses 133 can engage with the engagement projection 114*b* when the sleeve 13 is inserted to be slid in the housing portion 112 of the head pad 11.

Figure 7:
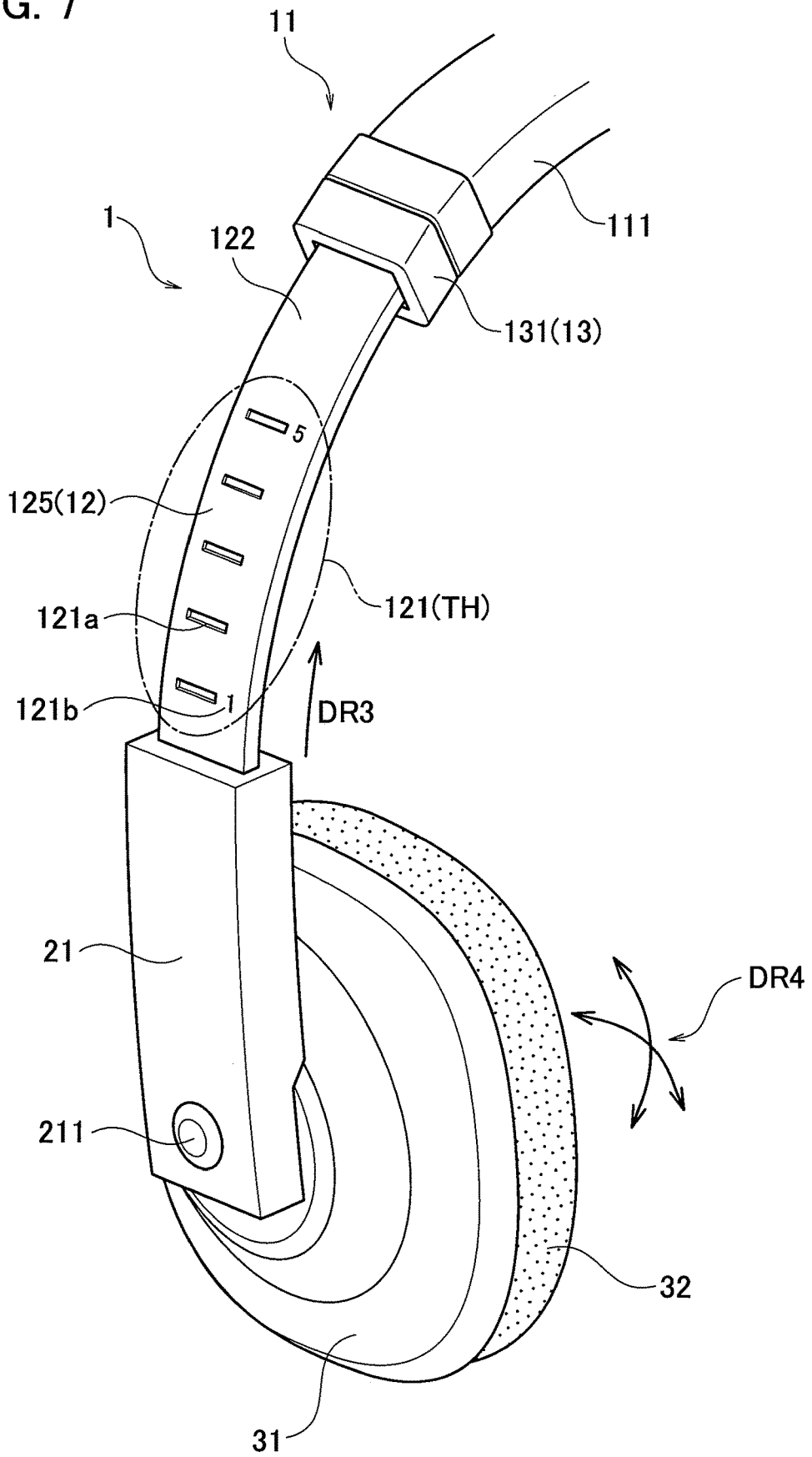
FIG. 7 is a partial perspective view showing the band of the headphone device in the first state according to one or more embodiments.

FIG. 7 and FIG. 8 are partial perspective views showing the band 12 and the peripheral portions in the first state and the second state of the head band 1.

As shown in FIG. 7, the outer surface 122 of the band 12 on the outer side is provided with hanger position indicators 121. The hanger position indicators 121 are marks for positioning the hanger 21 in the vertical direction, which are a group of slightly recessed marks 121*a* and 121*b*. The hanger position indicators 121 collectively serve as an adjusted-amount recognition part TH so as to allow the user to visually recognize the adjusted position of the hanger 21.

The marks illustrated in FIG. 7 include linear marks 121*a* and numerical marks 121*b*, for example.

The user, when moving each hanger 21 upward in the direction indicated by the arrow DR3 to adjust the vertical position as shown in FIG. 7, can easily recognize the position of the moved hanger 21 supporting the housing 31 due to the marks not hidden but still remaining visible on the hanger 21.

As shown in FIG. 7, the housing 31 pivots on the pivot support 211 at a predetermined angle in the vertical direction and the front-rear direction indicated by the arrows DR4.

The head pad 11, having the structure as described above, can allow the user of the headphone device 51 to slide the sleeve 13 with the fingers so that the sleeve 13 is drawn out of/retracted into the pad base portion 111 in the direction indicated by the arrow DR5 in FIG. 8.

When the sleeve 13 is moved to be drawn out of/retracted into the pad base portion 111, the engagement projection 114*b* of the pad base portion 111 elastically engages with one of the engagement recesses 133 in the engagement recess group 133G of the sleeve 13 located at a position corresponding to the drawn/retracted amount of the sleeve 13. The engagement between the engagement projection 114*b* and each engagement recess 133 can be released when the sleeve 13 is slid with power applied to a certain extent.

The user thus can feel the sense of clicking at predetermined moving intervals while moving the sleeve 13 to be drawn out of/retracted into the pad base portion 111. The sleeve 13 is held at any position while being releasable with the fingers.

The sleeve length indicating portion 137, serving as the adjusted-amount recognition part TH, is the group of the marks 137*a* aligned at regular intervals, so as to allow the user to easily recognize the drawn position of the sleeve 13, namely, the drawn amount of the sleeve 13 by a visual check, thus allowing a highly-repeatable adjustment.

Aligning the predetermined pitch of the engagement recesses 133 provided on the bottom of the inner groove 136 with the predetermined interval between the respective marks 137*a* in the sleeve 13, enhances the correlation between the drawn position and the drawn amount of the sleeve 13, further facilitating the adjusting operation.

The headphone device 51 provided with both the hanger position indicators 121 and the sleeve length indicating portion 137 can allow the user to recognize both the vertical adjustment position of the hanger 21 with respect to the band 12 and the drawn position of each sleeve 13 with respect to the band 12.

The headphone device 51 including the above head band 1 enables the lateral pressure adjustment in association with the change in the drawn amount of the sleeves 13 drawn out of the head pad 11, as described above. The lateral pressure adjustment is described in detail below.

FIG. 1, FIG. 3, and FIG. 4 each show a natural state of the headphone device 51 in the first, second, and third states with no power applied. The user, when putting the headphone device 51 on the head, widens the distance between the pair of the housings 31 in the right-left direction to wear the housings 31 over the ears. The head band 1 is thus elastically deformed to be widened outward in the direction in which the curvature decreases. The elastic repulsive force of the head band 1 in response to the deformation pushes the ears or temples of the user via the ear pads 32, and the user senses the elastic repulsive force as a lateral pressure.

The supported position of each housing 31 on the hanger 21 shown in FIG. 1 is referred to below as a reference point P21 to estimate expansion/contraction deformation of the head band 1. The distance between the reference points P21 on the right and left sides of the pair of the housings 31 shown in FIG. 1 is defined as distance L0.

When the headphone device 51 in the first state shown in FIG. 1 is put on the head, the head band 1 is widened to shift the reference points P21 to in-use reference points P21α outside the original reference points P21 in the directions indicated by the arrows DR1. The shifted distance L1 from each reference point P21 to each in-use reference point P21α substantially corresponds to the deformed amount at the tip part of the head band 1. The in-use reference points P21α are set to the outside of the reference points P21 when the extending portions 125 of the band 12 are presumed to be formed to have a radius R1.

Since the flexural rigidity is sufficiently greater for the head pad 11, the hanger 21, and the sleeves 13 than for the band 12, only the extending portions 125 of the band 12 in the head band 1 are substantially deformed. The base of the band 12 toward the sleeve head 131 in this state serves as a deformation fulcrum P1.

Since the extending portions 125 of the band 12 are deformed so as to vary in radius from the radius R2 smaller than the radius R1 to an in-use radius greater than the radius R1, the elastic repulsive force of the extending portions 125 in use is at least greater than that when the radius varies between the radius R1 and the in-use radius upon the deformation.

In the natural state of the headphone device 51 in the second state as shown in FIG. 3, most of the extending portions 125 of the band 12 is covered with the sleeves 13, so that the radius of curvature of the covered part is corrected to the radius R1. The distance L2 between the respective reference points P22 in this state is greater than the distance L0 between the reference points in the first state. The reference points P22 are thus located closer to the in-use reference points P21α by the distance L22 than the reference points P21 in the first state.

When the headphone device 51 in the second state is put on the head, the extending portions 125 are deformed with the radius varying from the radius R1 to the in-use radius, resulting in a smaller degree of deformation than in the first state. The elastic repulsive force of the extending portions 125 when the headphone device 51 in the second state is in use is thus smaller than that in the first state under the similar conditions, so that the user senses a smaller lateral pressure.

In the natural state of the headphone device 51 in the third state as shown in FIG. 4, a smaller part of the extending portions 125 than in the second state is covered with the sleeves 13, and the radius of curvature of the covered part is corrected to the radius R1. The corrected degree in the entire extending portions 125 in the third state is smaller than that in the second state. The distance L3 between the respective reference points P23 in the third state is thus greater than the distance L0 in the first state and smaller than the distance L2 in the second state.

The lateral pressure that the user senses when the headphone device 51 in the third state is in use is at a level between the first state and the second state. The user can adjust the lateral pressure to any level between the maximum and the minimum depending on the slid amount of the sleeves 13.

The headphone device 51 described above enables the adjustment of the radius of curvature of the extending portions 125 of the band 12 in association with the slide of the sleeves 13. The radius of curvature of the extending portions 125 is greater in the second state than in the first state. The degree of deformation of the extending portions 125 when the headphone device 51 is put on the head is thus smaller in the second state than in the first state, leading to a smaller elastic repulsive force. The lateral pressure that the user senses is smaller in the second state accordingly.

The headphone device 51 enables the lateral pressure adjustment independently of the vertical adjustment of the hangers 21. The user thus can adjust the lateral pressure easily and precisely so as to be fitted for the shape of the head or a desirable feeling when wearing the headphone device 51.

The headphone device 51 includes the hanger position indicators 121 and the sleeve length indicating portion 137. The user thus can visually recognize the vertical adjustment position of the respective hangers 21 and the drawn amount of the respective sleeves 13 drawn out of the head pad 11, further facilitating the lateral pressure adjustment.

The headphone device 51 enables the lateral pressure adjustment with the smaller number of components.

The headphone device 51 can also allow the user to adjust the lateral pressure only by the extension/retraction of the sleeves 13 with respect to the head pad 11, while eliminating rotating operations such as screw rotation. The headphone device 51 thus reduces the time to adjust the lateral pressure and facilitates the adjusting operation.

The headphone device 51 further allows the user to separately adjust the lateral pressure of the respective right and left housings. The user thus can differently set the lateral pressure on each of the right and left sides to a desired level when the user wants to intentionally change the balance of the lateral pressure on the right and left sides or when the user wants to wear the headphone device 51 with an asymmetric hairstyle, so as to wear the headphone device 51 with a more comfortable feeling.

The present invention is not intended to be limited to the above-described one or more embodiments, and various modifications can be made without departing from the scope of the present invention.

The headphone device 51 may be modified into a headphone device 52 according to a first modified example (refer to FIG. 3) in which the radius R2 set for the extending portions 125 of the band 12 is changed to a radius greater than the radius R1 set for the sleeves 13 and the head pad 11.

The headphone device 52 of the first modified example allows the pair of the housings 31 to be most distant from each other in the state in which the sleeves 13 are slid toward the head pad 11 to the maximum, and to be closest to each other in the state in which the sleeves 13 are slid away from the head pad 11 to the maximum.

The headphone device 52, when the sleeves 13 are slid toward the head pad 11 to the maximum, is in the second state for the headphone device 51 in which the deformation of the extending portions 125 in use is at the minimum. The headphone device 52, when the sleeves 13 are slid away from the head pad 11 to the maximum, is in the first state for the headphone device 51 in which the deformation of the extending portions 125 in use is at the maximum.

The headphone device 52 has the same configuration as the headphone device 51 in that the radius of curvature of the extending portions 125 is corrected to the radius R1 when the extending portions 125 are covered with the sleeves 13. FIG. 3 thus illustrates the headphone device 52 in the state in which the sleeves 13 are drawn out to the maximum.

The headphone devices 51 and 52 enable the lateral pressure adjustment in association with the slide of the sleeves 13. Drawing the sleeves 13 out of the head pad 11 decreases the lateral pressure in the headphone device 51, and increases the lateral pressure in the headphone device 52.

The headphone devices 51 and 52 differ from each other only in the setting of the radius of curvature of the extending portions 125 of the band 12, and have substantially the same structure. The headphone device 52 thus can facilitate the lateral pressure adjustment with a smaller number of components, as in the case of the headphone device 51.

The hanger position indicators 121 and the sleeve length indicating portion 137 each serving as the adjusted-amount recognition part TH, may be configured to allow the user to recognize the respective positions either visually or tactually.

The headphone devices 51 and 52 are not limited to the stereo system including the paired housings 31 as described above, and may be a single ear headphone including a head band placed on the top of the head, a housing 31 corresponding to the ear on one side of the head, and a contact pad in contact with the head on the opposite side on which the other ear is exposed.

The headphone device 51 has been illustrated with the case in which the head band 1 is put across the top of the head, but the head band 1 may be positioned across the back of the head or across the back of the neck. The same is also applied to the case of the headphone device 52.

The headphone device 51 has been illustrated with the case of including the single band 12 inserted through the head pad 11 and extending out of the head pad 11 at both ends, but is not limited to this case. For example, the headphone device 51 may include a pair of bands for each ear without penetrating the fixed wall portion 113 of the head pad 11, each band having one end fixed to the inside and the other end connected with the hanger 21 and the housing 31. The same is also applied to the case of the headphone device 52.

The sleeves 13 in the respective headphone devices 51 and 52 are not limited to the case of completely covering the band 12 without exposing outward. For example, the sleeves 13 may each have an opening at the base 132 on which the band 12 is exposed in order to reduce the weight and improve the design and quality. The opening may be a hole such as a circular hole, a rectangular hole, and an elongated hole, or a slit cut at the edge and extending in the longitudinal direction of the base 132.

The sleeves 13 in the respective headphone devices 51 and 52 are not limited to the case of being housed in the housing portions 112 in the head pad 11 and drawn out along the band 12. For example, the sleeves 13 may be fitted to the outside of the pad base portion 111 of the head pad 11 and slidable along the band 12.

A modified headphone device 52A of a second modified example, which is either a headphone device 51A obtained such that the headphone device 51 is subjected to the above modifications or a headphone device 52A obtained such that the headphone device 52 is subjected to the above modifications, is described below with reference to FIG. 9 and FIG. 10.

Figure 9:
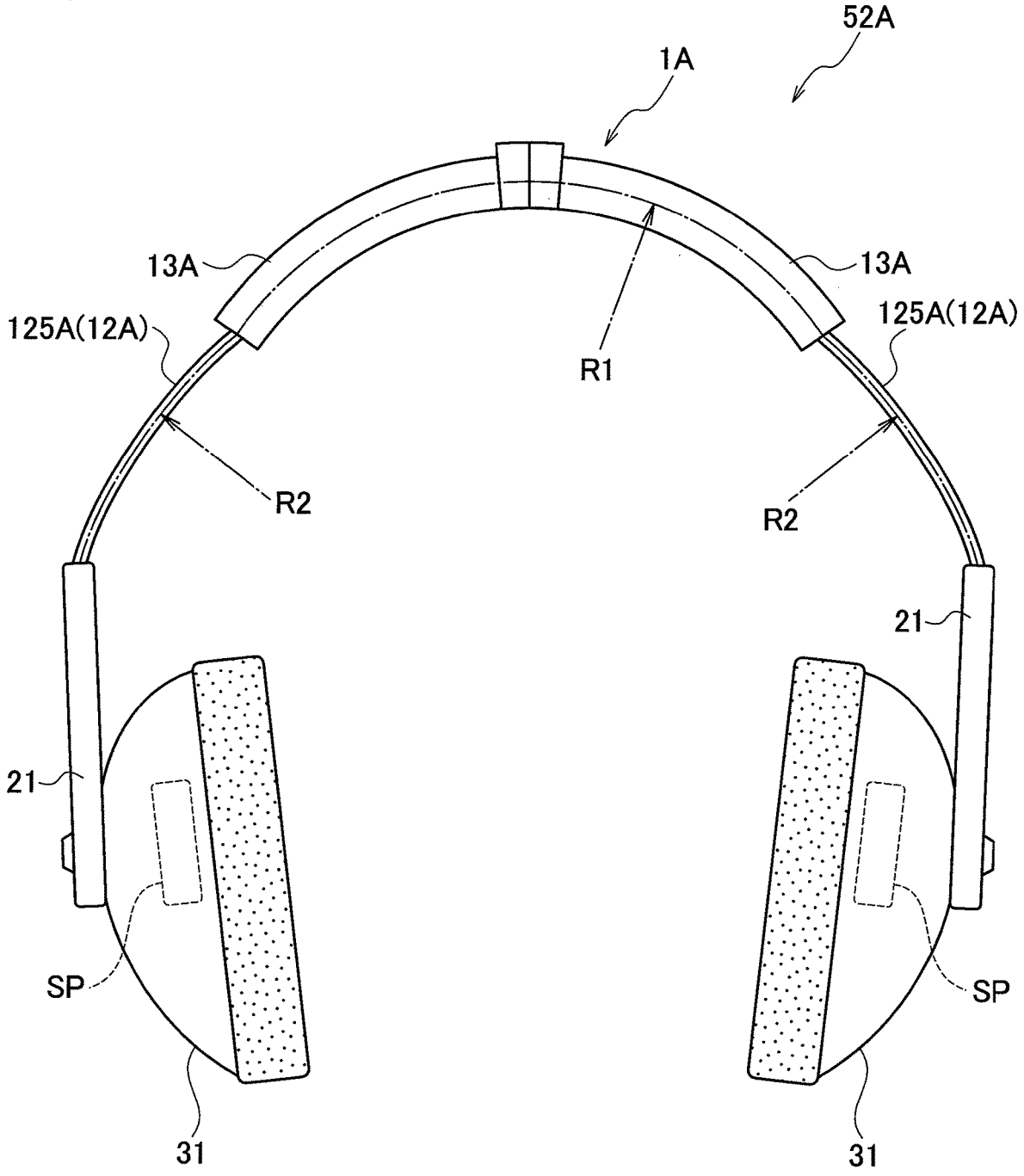
FIG. 9 is a partial front view showing a headphone device of a second modified example in a first state according to one or more embodiments.

FIG. 9 is a front view showing the headphone device 52A in a first state in which sleeves 13A are slid away from hangers 21 to the maximum. FIG. 10 is a front view showing the headphone device 52A in a second state in which the sleeves 13A are slid toward the hangers 21 to the maximum, as compared with the headphone device 52A in the first state shown in FIG. 9.

The headphone device 52A includes a head band 1A, the hangers 21, and housings 31. The head band 1A includes a head pad 11A, a band 12A, and the sleeves 13A.

The sleeves 13A are fitted to the outside of a pad base portion 111A of the head pad 11A, so as to cover the head pad 11A in the first state shown in FIG. 9. The sleeves 13A are slid in the direction indicated by the arrows DR6 shown in FIG. 10 so as to expose the head pad 11A to the outside. The sleeves 13A are slidable in the longitudinal direction while serving as the head pad 11A.

The band 12A has an arc shape having a radius R1 at a portion housed in the head pad 11A, and includes extending portions 125A extending from both ends of the head pad 11A and having an arc shape with a radius R2 greater than the radius R1, as shown in FIG. 9.

Figure 10:
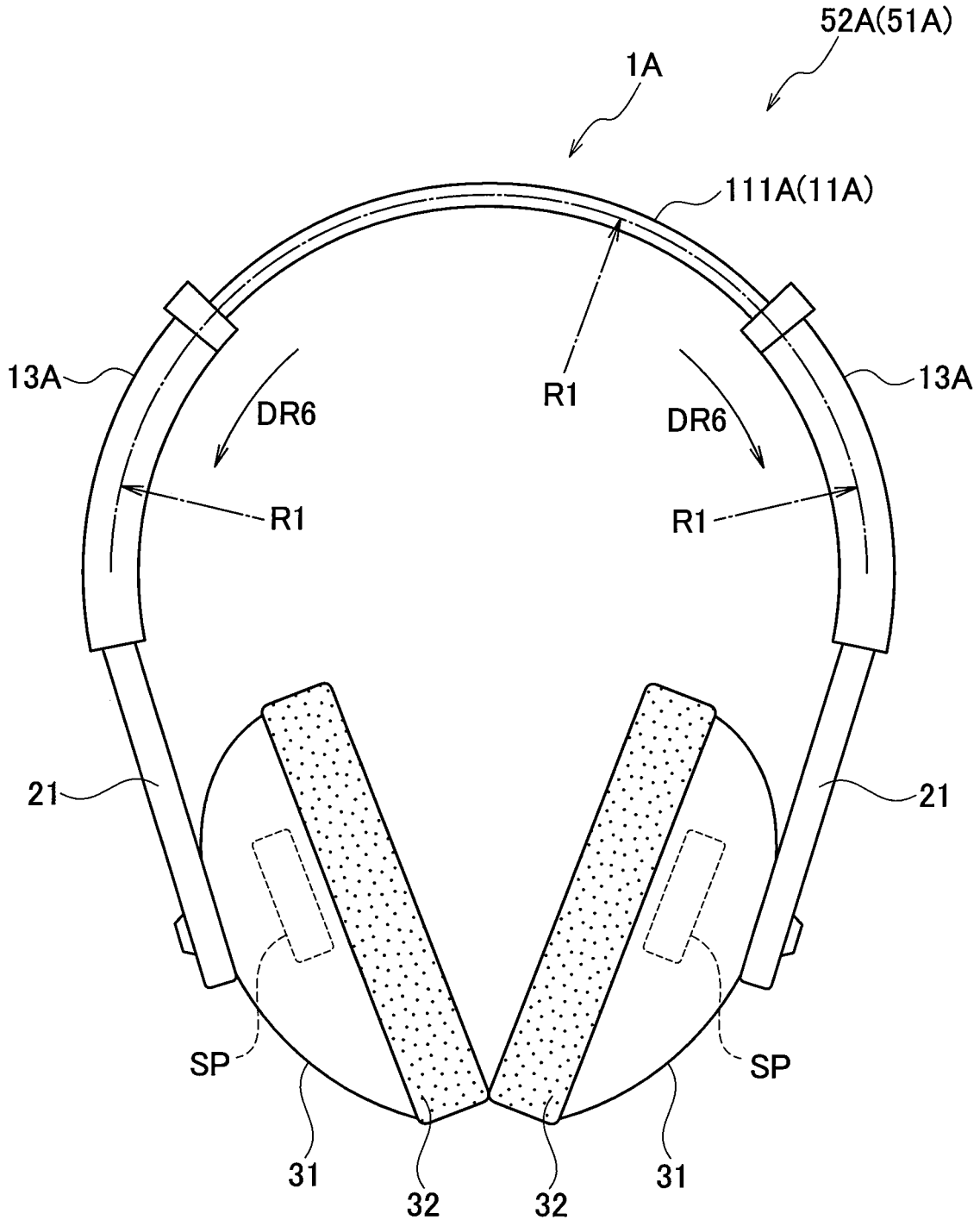
FIG. 10 is a partial front view showing the headphone device of the modified example in a second state according to one or more embodiments.

As shown in FIG. 10, the sleeves 13A in the first state are slid in the direction indicated by the arrows DR6, so as to correct the radius of curvature of the extending portions 125A, which have a smaller flexural rigidity than the sleeves 13A, to the radius R1 similar to that of the sleeves 13A.

The distance between the paired housings 31 in the natural state can be adjusted to be smaller, and the lateral pressure can be adjusted only by the sliding operation of the sleeves 13A, as in the case of the headphone device 51.

Next, the headphone device 51A, in which the radius R2 set for the extending portions 125A of the band 12A in the headphone device 52A is set to be smaller than the radius R1 set for the sleeves 13A and the head pad 11A, is described below as a third modified example.

The headphone device 51A of the third modified example in the natural state leads the distance between the pair of the housings 31 to be minimized when the sleeves 13A are slid to cover the head pad 11A to the maximum, and leads the distance between the pair of the housings 31 to be maximized when the sleeves 13A are slid away from the head pad 11A to the maximum.

The headphone device 51A corresponds to the first state for the headphone device 51 when the sleeves 13A are slid to cover the head pad 11A to the maximum so that the deformation of the extending portions 125A in use is maximized. The headphone device 51A corresponds to the second state for the headphone device 51 when the sleeves 13A are slid away from the head pad 11A to the maximum so that the curvature of the extending portions 125A in use is minimized.

The headphone device 51A has the same configuration as the headphone device 52A in that the radius of curvature of the extending portions 125A is corrected to the radius R1 of the sleeves 13A when the extending portions 125A are covered with the sleeves 13A. FIG. 10 thus illustrates the headphone device 51A in the state in which the sleeves 13A are slid away from the head pad 11A to the maximum.

The headphone devices 51A and 52A described above enable the lateral pressure adjustment in association with the slide of the sleeves 13A. Sliding the sleeves 13A away from the head pad 11A decreases the lateral pressure in the headphone device 51A, and increases the lateral pressure in the headphone device 52A.

The headphone devices 51A and 52A differ from each other only in the setting of the radius of curvature of the extending portions 125A of the band 12A, and have substantially the same structure. The headphone device 51A thus can facilitate the lateral pressure adjustment with a smaller number of components, as in the case of the headphone device 52A.

While the head pad 11 and the sleeves 13 slid along the head pad 11 have the arc shape so as to allow a smooth slide, the head pad 11 and the sleeves 13 do not necessarily have exactly the arc shape and may have any shape that allows a slide between the head pad 11 and the sleeves 13. The extending portions 125 of the band 12, which are corrected by the sleeves 13, are only required to have a curved shape, instead of the completely arc shape.

Although the head pad 11, the sleeves 13, and the band 12 have been illustrated above with the shapes with a radius R1 or R2, each radius can be replaced with a radius of curvature when each element does not have a completely arc shape but have a curved shape. The radius of curvature of each element, when greatly varying depending on the portion (from the end portion to the middle portion, for example), may be replaced with an average radius of curvature.

The headphone devices 51 and 52 in which the sleeves 13 are fitted to the inside of the head pad 11, and the headphone devices 51A and 52A in which the sleeves 13A are fitted to the outside of the head pad 11A, can facilitate the lateral pressure adjustment in association with the slide of the sleeves 13 or 13A made by fingers.

What is claimed is:

1. A headphone device comprising:

a head pad having a curved shape with a first radius of curvature;

a band extending from an edge of the head pad into a curved shape with a second radius of curvature different from the first radius of curvature, and supporting a housing, via a hanger, housing a speaker unit; and a sleeve having a curved shape with the first radius of curvature and slidable along the head pad to cover the band so as to change the radius of curvature at a part of the band covered with the sleeve to approximate to the first radius of curvature.

2. The headphone device according to claim 1, wherein the sleeve has a greater flexural rigidity than the band.

3. The headphone device according to claim 1, wherein at least part of the sleeve is retractable into the head pad.

4. The headphone device according to claim 1, wherein the sleeve includes a mark for indicating a slid amount of the sleeve with respect to the head pad.

* * * * *